US006210137B1

(12) United States Patent
Kobayashi et al.

(10) Patent No.: US 6,210,137 B1
(45) Date of Patent: Apr. 3, 2001

(54) SCROLL FLUID MACHINE

(75) Inventors: Yoshio Kobayashi; Susumu Sugiura; Kiminori Iwano; Yasuhiko Sekino; Katsushi Hidano; Susumu Sakamoto; Junichi Nagasawa; Toshitsugu Suzuki, all of Kanagawa-ken (JP)

(73) Assignee: Tokico Ltd., Kanagawa-ken (JP)

( * ) Notice: Subject to any disclaimer, the term of this patent is extended or adjusted under 35 U.S.C. 154(b) by 0 days.

(21) Appl. No.: 09/474,020

(22) Filed: Dec. 28, 1999

(30) Foreign Application Priority Data

Dec. 28, 1998 (JP) ..... 10-374739

(51) Int. Cl.[7] ..... F01C 1/02

(52) U.S. Cl. ..... 418/55.6; 418/63; 418/88; 418/91; 418/94

(58) Field of Search ..... 418/55.6, 63, 88, 418/91, 94

(56) References Cited

U.S. PATENT DOCUMENTS

| | | | | |
|---|---|---|---|---|
| 4,637,786 | * | 1/1987 | Matoba et al. | 418/55.6 |
| 4,743,181 | * | 5/1988 | Murayama et al. | 418/55.6 |
| 4,818,198 | * | 4/1989 | Tamura et al. | 418/55.6 |
| 4,917,582 | * | 4/1990 | Fraser, Jr. et al. | 418/55.6 |
| 4,946,361 | * | 8/1990 | DeBlois et al. | 418/55.6 |
| 4,958,993 | * | 9/1990 | Fujio | 418/55.6 |
| 5,810,573 | * | 9/1998 | Mitsunaga et al. | 418/94 |

FOREIGN PATENT DOCUMENTS

| | | | | |
|---|---|---|---|---|
| 60-204990 | * | 10/1985 | (JP) | 418/94 |
| 63-205490 | * | 8/1988 | (JP) | 418/88 |
| 2-049989 | * | 2/1990 | (JP) | 418/55.6 |
| 5-133358 | * | 5/1993 | (JP) | 418/88 |
| 5-180179 | * | 7/1993 | (JP) | 418/94 |
| 5-272473 | * | 10/1993 | (JP) | 418/88 |

* cited by examiner

*Primary Examiner*—Thomas Denion
*Assistant Examiner*—Theresa Trien
(74) *Attorney, Agent, or Firm*—Wenderoth, Lind & Ponack, L.L.P.

(57) ABSTRACT

A scroll fluid machine having a lubrication pump provided between sliding contact surfaces of an orbiting scroll member and a thrust bearing in a casing. The pump has an orbiting member accommodating recess provided in the sliding contact surface of the thrust bearing. An orbiting member projects from the sliding contact surface of the orbiting scroll member into the recess. A slide plate defines a suction chamber and a discharge chamber in the recess. As the orbiting scroll member orbits, the orbiting member orbits in the recess, causing a lubricant contained in the casing to be sucked from a suction passage and delivered to the inside of a boss portion accommodating an orbiting bearing.

18 Claims, 10 Drawing Sheets

SCROLL FLUID MACHINE

BACKGROUND OF THE INVENTION

The present invention relates to a scroll fluid machine suitable for use in an air compressor, a vacuum pump, etc.

A generally known scroll fluid machine has a casing and a fixed scroll member provided in the casing. The fixed scroll member has a spiral wrap portion standing on an end plate. A driving shaft is rotatably provided in the casing. An orbiting scroll member is orbitably provided on the distal end of the driving shaft in the casing. The orbiting scroll member has a spiral wrap portion standing on an end plate so as to overlap the wrap portion of the fixed scroll member to define a plurality of compression chambers.

In this type of known scroll fluid machine, the driving shaft is externally driven to rotate, causing the orbiting scroll member to perform an orbiting motion with a predetermined eccentricity with respect to the fixed scroll member, thereby sucking a fluid, e.g. air, from a suction opening provided at the outer periphery of the fixed scroll member, and successively compressing the fluid in the compression chambers formed between the wrap portions of the fixed and orbiting scroll members. Finally, the compressed fluid is discharged to the outside from a discharge opening provided in the center of the fixed scroll member.

In another known scroll fluid machine, a lubrication pump is provided between the casing and the outer periphery of the end plate of the orbiting scroll member. The lubrication pump operates in response to the orbiting motion of the orbiting scroll member to lubricate the driving shaft, the orbiting scroll member, etc. That is, a lubricant contained in the casing is led to the area between the casing and the outer periphery of the end plate of the orbiting scroll member by the lubrication pump and thus supplied to the driving shaft, the orbiting scroll member, etc.

Incidentally, in the above-described known scroll fluid machine, the lubrication pump is provided between the inner periphery of the casing and the outer periphery of the end plate of the orbiting scroll member. Consequently, the lubrication pump is placed near the sliding contact surfaces of the orbiting and fixed scroll members, and it is likely that the lubricant pressurized by the lubrication pump will enter the area between the sliding contact surfaces of the orbiting and fixed scroll members.

Therefore, the prior art involves the danger that the high-pressure lubricant, which has been pressurized in the pump chamber of the lubrication pump, may enter the area between the sliding contact surfaces of the fixed and orbiting scroll members and leak into the compression chambers. If the lubricant leaks into the compression chambers, it is difficult to discharge a clean compressed fluid to the outside. Thus, if there is likelihood that the lubricant may leak, the apparatus cannot be improved in performance and reliability.

In view of the above-described problems with the prior art, an object of the present invention is to provide a scroll fluid machine designed to be capable of preventing the entry of the lubricant from the lubrication pump into the compression chambers and of discharging a clean compressed fluid at all times and also capable of efficiently lubricating the driving shaft, etc. and hence improving the apparatus in performance, reliability and so forth.

SUMMARY OF THE INVENTION

The present invention is applicable to a scroll fluid machine including a casing and a fixed scroll member provided in the casing. The fixed scroll member has a spiral wrap portion standing on an end plate. A driving shaft is rotatably provided in the casing. An orbiting scroll member is orbitably provided at the distal end of the driving shaft through an orbiting bearing in the casing. The orbiting scroll member has a spiral wrap portion standing on an end plate so as to overlap the wrap portion of the fixed scroll member to define a plurality of compression chambers. A thrust bearing is provided in the casing so as to come in sliding contact with the rear side of the orbiting scroll member to bear a thrust load acting on the orbiting scroll member.

An arrangement adopted by the present invention is characterized by a lubrication pump provided between the rear side of the orbiting scroll member and the thrust bearing. The lubrication pump has a pump chamber defined between a sliding contact surface on the rear side of the orbiting scroll member and a sliding contact surface of the thrust bearing. The lubrication pump operates in response to the motion of the orbiting scroll member. A lubricant suction passage is provided in the thrust bearing to lead a lubricant contained in the casing into the pump chamber of the lubrication pump. A discharge passage is provided in the orbiting scroll member to deliver the lubricant sucked into the pump chamber of the lubrication pump to lubricating points.

With the above-described arrangement, as the orbiting scroll member orbits, the lubrication pump operates in response to the motion of the orbiting scroll member, causing the lubricant contained in the casing to be led into the pump chamber through the suction passage provided in the thrust bearing. The lubricant led into the pump chamber is delivered to lubricating points, for example, the driving shaft and the orbiting bearing, by the lubrication pump through the discharge passage provided in the orbiting scroll member to cool and lubricate the driving shaft, the orbiting bearing, etc. While flowing through the discharge passage, the lubricant from the lubrication pump cools the whole orbiting scroll member.

The pump chamber of the lubrication pump is provided between the sliding contact surface on the rear side of the orbiting scroll member and the sliding contact surface of the thrust bearing. That is, the pump chamber is provided on the side of the end plate of the orbiting scroll member remote from the compression chambers. Therefore, the pump chamber can be isolated from the compression chambers. Thus, the lubricant pressurized in the pump chamber of the lubrication pump can be prevented from leaking to the compression chamber side.

In the present invention, the lubrication pump may be arranged as follows. An orbiting member accommodating recess is provided in either one of the sliding contact surface on the rear side of the orbiting scroll member and the sliding contact surface of the thrust bearing to define a pump chamber between the orbiting member accommodating recess and the other of the sliding contact surfaces. An orbiting member projects from the other of the sliding contact surfaces into the orbiting member accommodating recess. The orbiting member performs a relative orbiting motion along the peripheral wall surface of the orbiting member accommodating recess in response to the motion of the orbiting scroll member. A movable partition is provided in the orbiting member accommodating recess so as to be movable relative to the orbiting member accommodating recess. The movable partition cooperates with the orbiting member to divide the pump chamber into a suction chamber and a discharge chamber in the orbiting member accommodating recess. A partition driving mechanism drives the movable partition to perform relative movement in the orbiting member accommodating recess in response to the motion of the orbiting member.

In the above-described arrangement, as the orbiting scroll member orbits, the orbiting member, which projects from the other of the sliding contact surfaces, performs a relative orbiting motion in the orbiting member accommodating recess, which is provided in the one of the sliding contact surfaces, along the peripheral wall surface thereof. In addition, the movable partition is driven by the partition driving mechanism to perform relative movement in the orbiting member accommodating recess in response to the motion of the orbiting member. At this time, the pump chamber in the orbiting member accommodating recess is divided into the suction chamber and the discharge chamber by the orbiting member and the movable partition. Therefore, the lubricant from the suction passage can be sucked into the suction chamber, and while doing so, it can be delivered from the discharge chamber to the discharge passage.

In the present invention, the partition driving mechanism may be arranged as follows. A cavity is provided in the one of the sliding contact surfaces at a distance from the orbiting member accommodating recess. A guide groove is formed in the one of the sliding contact surfaces between the cavity and the orbiting member accommodating recess. The guide groove is contiguous at both longitudinal ends thereof with the cavity and the orbiting member accommodating recess. A driving projection projects from the other of the sliding contact surfaces into the cavity. The driving projection performs a relative orbiting motion in the cavity in response to the motion of the orbiting scroll member. The movable partition is a slide plate slidably held between the orbiting member and the driving projection. The slide plate is slidable longitudinally along the guide groove.

In the above-described arrangement, as the orbiting scroll member orbits, the driving projection, which projects from the other of the sliding contact surfaces, can perform a relative orbiting motion in the cavity as in the case of the orbiting member. At this time, the slide plate slides longitudinally along the guide groove by following the motion of the orbiting member and the driving projection in a state where both ends of the slide plate are in sliding contact with the orbiting member and the driving projection. Consequently, the suction and discharge chambers, which are defined in the orbiting member accommodating recess by the orbiting member and the slide plate, expand or contract in response to the motion of the orbiting member. Thus, the lubricant sucked into the suction chamber can be delivered from the discharge chamber.

In the present invention, the sliding contact surfaces of the orbiting member and the driving projection that are in sliding contact with the slide plate may be plane surfaces which are parallel to each other. Thus, when the orbiting scroll member orbits, the orbiting member and the driving projection, which are each integrally provided on the orbiting scroll member, can be guided relatively along the slide plate. In addition, the slide plate slides longitudinally along the guide groove. Therefore, it is possible to construct a rotation preventing mechanism for preventing rotation of the orbiting scroll member by the orbiting member, the driving projection, the slide plate and the guide groove.

In the present invention, the one of the sliding contact surfaces may be provided with a lubricant reservoir constantly communicating with the orbiting member accommodating recess and the discharge passage. With this arrangement, as the orbiting scroll member orbits, the lubricant sucked into the orbiting member accommodating recess can be smoothly delivered from the lubricant reservoir to the discharge passage.

In the present invention, the discharge passage may be arranged to extend through the rear side portion of the orbiting scroll member and to open in a boss portion accommodating the orbiting bearing. Thus, the lubricant from the discharge passage can be supplied to the orbiting bearing.

In the present invention, the driving shaft may be provided with a balance weight projecting radially from the outer periphery of the driving shaft to obtain a rotational balance of the driving shaft with respect to the orbiting scroll member. The driving shaft may be further provided with a lubricant supply passage opening at one end thereof at a distal end of the driving shaft to communicate with the discharge passage. The other end of the lubricant supply passage opens at the outer peripheral surface of the driving shaft on the rear side of the boss portion.

With the above-described arrangement, the lubricant from the discharge passage can be supplied to the orbiting bearing, and the lubricant can also be supplied to the rear side of the orbiting scroll member from the outer peripheral surface of the driving shaft through the lubricant supply passage.

BRIEF DESCRIPTION OF THE DRAWINGS

in FIG. 1.

DETAILED DESCRIPTION OF THE INVENTION

A scroll fluid machine according to an embodiment of the present invention will be described below in detail with reference to the accompanying drawings. In the embodiment, the present invention is applied to a scroll air compressor as an example of scroll fluid machines.

FIGS. 1 to 10 show an embodiment of the present invention. Referring to the figures, a closed-end cylindrical casing 1 forms an outer frame of a scroll air compressor. The casing 1 has an annular bottom portion 1A. A cylindrical portion 1B extends from the outer periphery of the bottom portion 1A toward a fixed scroll member 3 (described later). A bearing portion 1C projects from the center of the bottom portion 1A toward the fixed scroll member 3. A lubricant 2 is contained in the casing 1.

Figure 1:
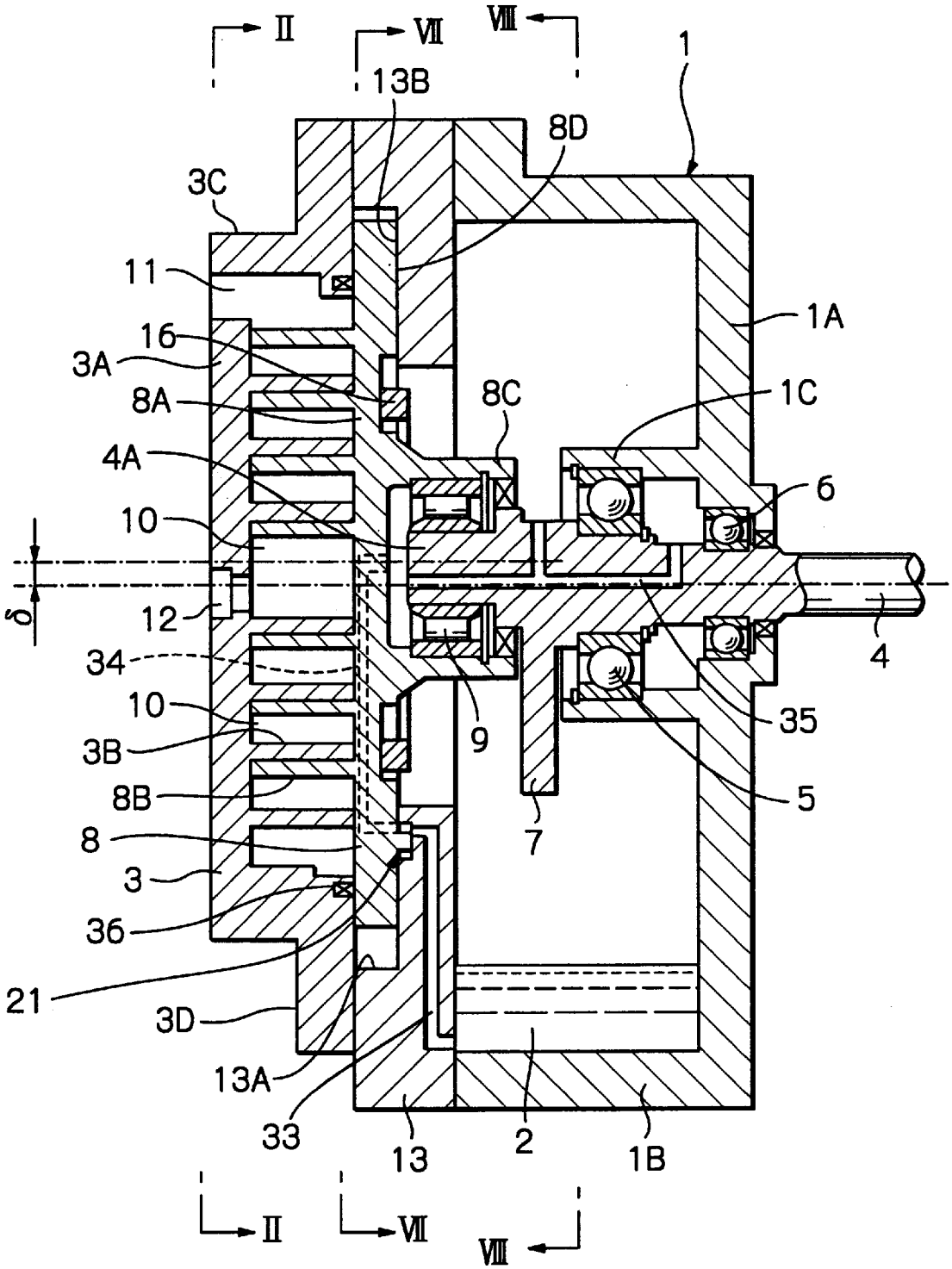
FIG. 1 is a longitudinal sectional view taken along the line I—I in FIG. 2, showing a scroll air compressor according to an embodiment of the present invention.
Figure 2:
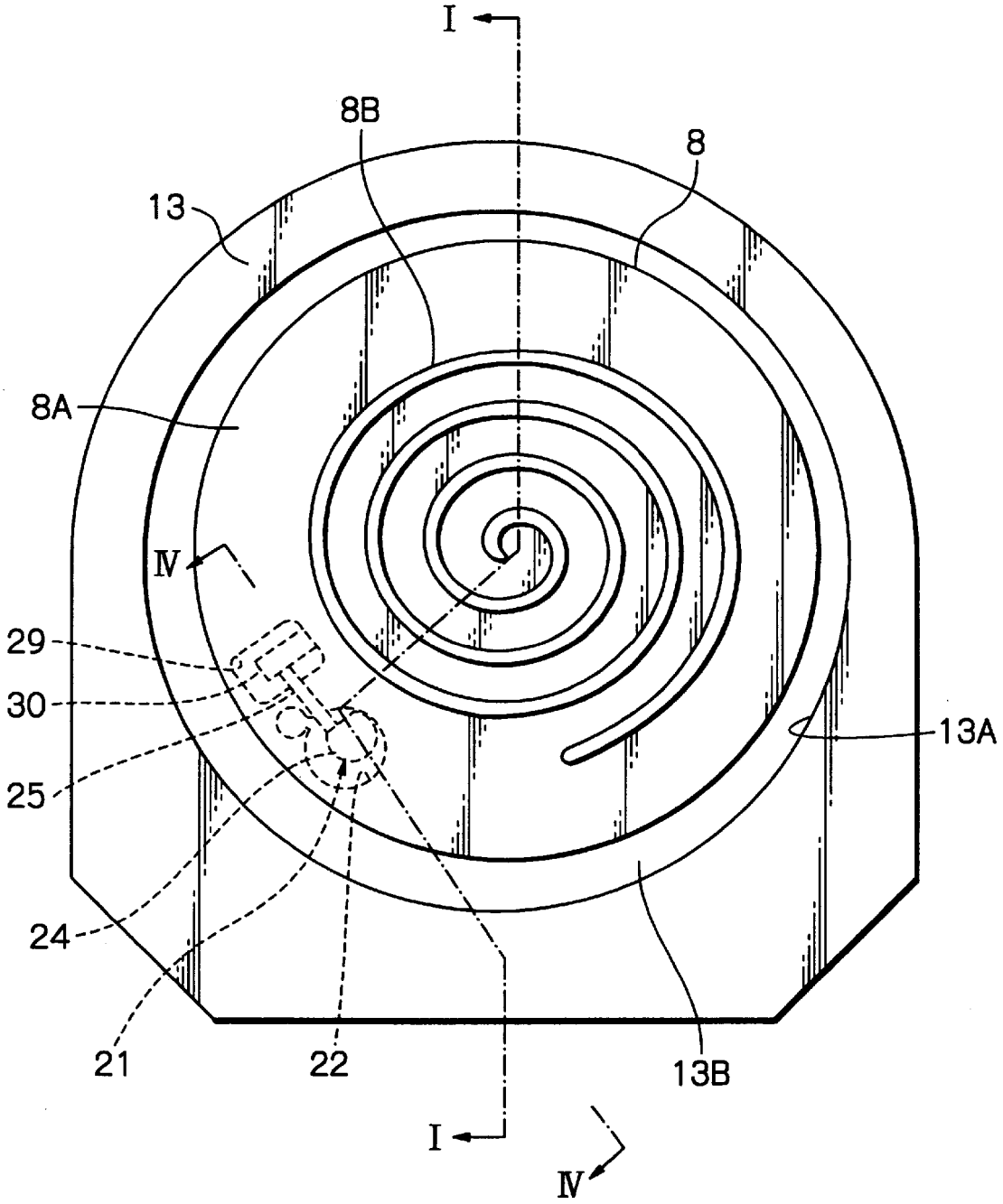
FIG. 2 is a front view as seen in the direction of the arrow II—II in FIG. 1, showing an orbiting scroll member, a thrust bearing, etc. with a fixed scroll member removed.
Figure 3:
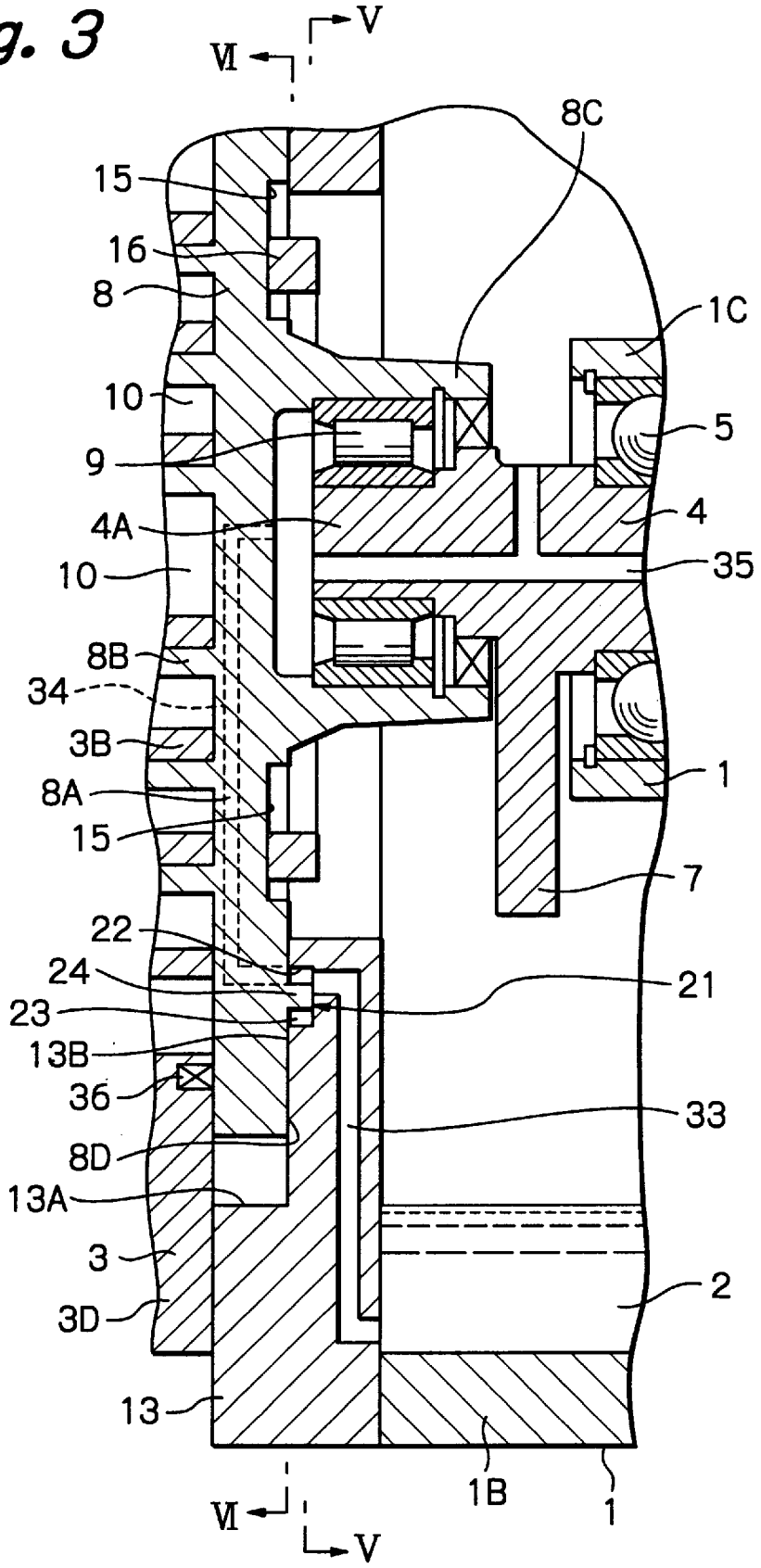
FIG. 3 is a fragmentary enlarged sectional view of the orbiting scroll member, the thrust bearing, a lubrication pump, etc.
Figure 4:
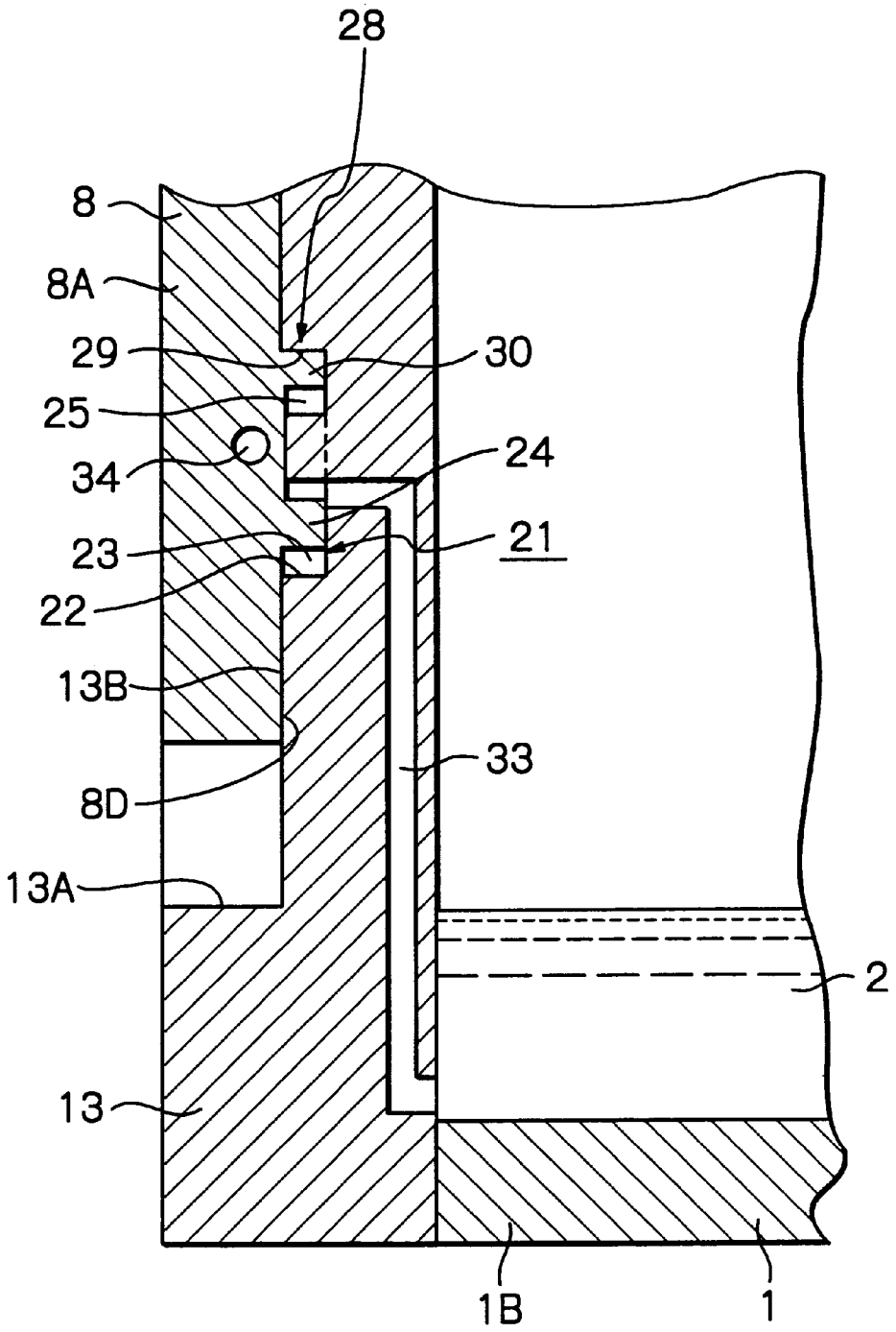
FIG. 4 is an enlarged sectional view as seen in the direction of the arrow IV—IV in FIG. 2, showing the orbiting scroll member, the thrust bearing, the lubrication pump, etc.

The fixed scroll member 3 is secured to the distal end of the casing 1. As shown in FIG. 1, the fixed scroll member 3 has an end plate 3A formed in an approximately disk-like shape. The end plate 3A is positioned so that the center thereof is coincident with the axis of a driving shaft 4 (described later). A spiral wrap portion 3B is provided on the obverse side of the end plate 3A. A cylindrical portion 3C projects axially from the outer peripheral edge of the end plate 3A so as to surround the wrap portion 3B. A flange portion 3D projects radially outward from the outer periphery of the cylindrical portion 3C and abuts on a thrust bearing 13 (described later).

The driving shaft 4 is rotatably supported by bearings 5 and 6 in the casing 1. The proximal end of the driving shaft 4 is connected to a driving source (not shown). The distal end portion of the driving shaft 4 extends into the casing 1 to form a crank 4A. The axis of the crank 4A is displaced with respect to the axis of the driving shaft 4 by a dimension δ.

A balance weight 7 is provided on the outer periphery of the driving shaft 4 between the bearing portion 1C of the casing 1 and a boss portion 8C of an orbiting scroll member 8 (described later). The balance weight 7 projects radially outward from the driving shaft 4 to obtain a rotational balance of the driving shaft 4 with respect to the orbiting scroll member 8.

The orbiting scroll member 8 is orbitably provided in the casing 1 in opposing relation to the fixed scroll member 3. As shown in FIG. 1, the orbiting scroll member 8 has an end plate 8A formed in the shape of a disk. A spiral wrap portion 8B extends axially from the obverse side of the end plate 8A.

The orbiting scroll member 8 further has a boss portion 8C projecting from the center of the rear side of the end plate 8A. The orbiting scroll member 8 is orbitably attached to the crank 4A of the driving shaft 4 through an orbiting bearing 9 accommodated in the boss portion 8C. The obverse side of the end plate 8A is adapted to come in sliding contact with the flange portion 3D of the fixed scroll member 3. The rear (reverse) side of the end plate 8A forms a sliding contact surface 8D adapted to come in sliding contact with a thrust bearing 13 (described later).

The orbiting scroll member 8 is positioned so that the wrap portion 8B overlaps the wrap portion 3B of the fixed scroll member 3 with an offset angle of 180 degrees, for example. Thus, a plurality of compression chambers 10 are defined between the two wrap portions 3B and 8B. During the operation of the scroll air compressor, air is sucked into the outermost compression chamber 10 from a suction opening 11 provided in an outer peripheral portion of the fixed scroll member 3, and the sucked air is successively compressed in the compression chambers 10 during the orbiting motion of the orbiting scroll member 8. Finally, the compressed air is discharged from the central compression chamber 10 to the outside through a discharge opening 12 provided in the center of the fixed scroll member 3.

An annular thrust bearing 13 is provided at the distal end of the cylindrical portion 1B of the casing 1. An annular cut portion 13A is formed on the inner periphery of the thrust bearing 13. The end plate 8A of the orbiting scroll member 8 is slidably mounted in the cut portion 13A. The cut portion 13A of the thrust bearing 13 has an annular sliding contact surface 13B adapted to come in sliding contact with the end plate 8A. The sliding contact surface 13B bears a thrust load acting on the orbiting scroll member 8 through contact with the end plate 8A.

Figure 5:
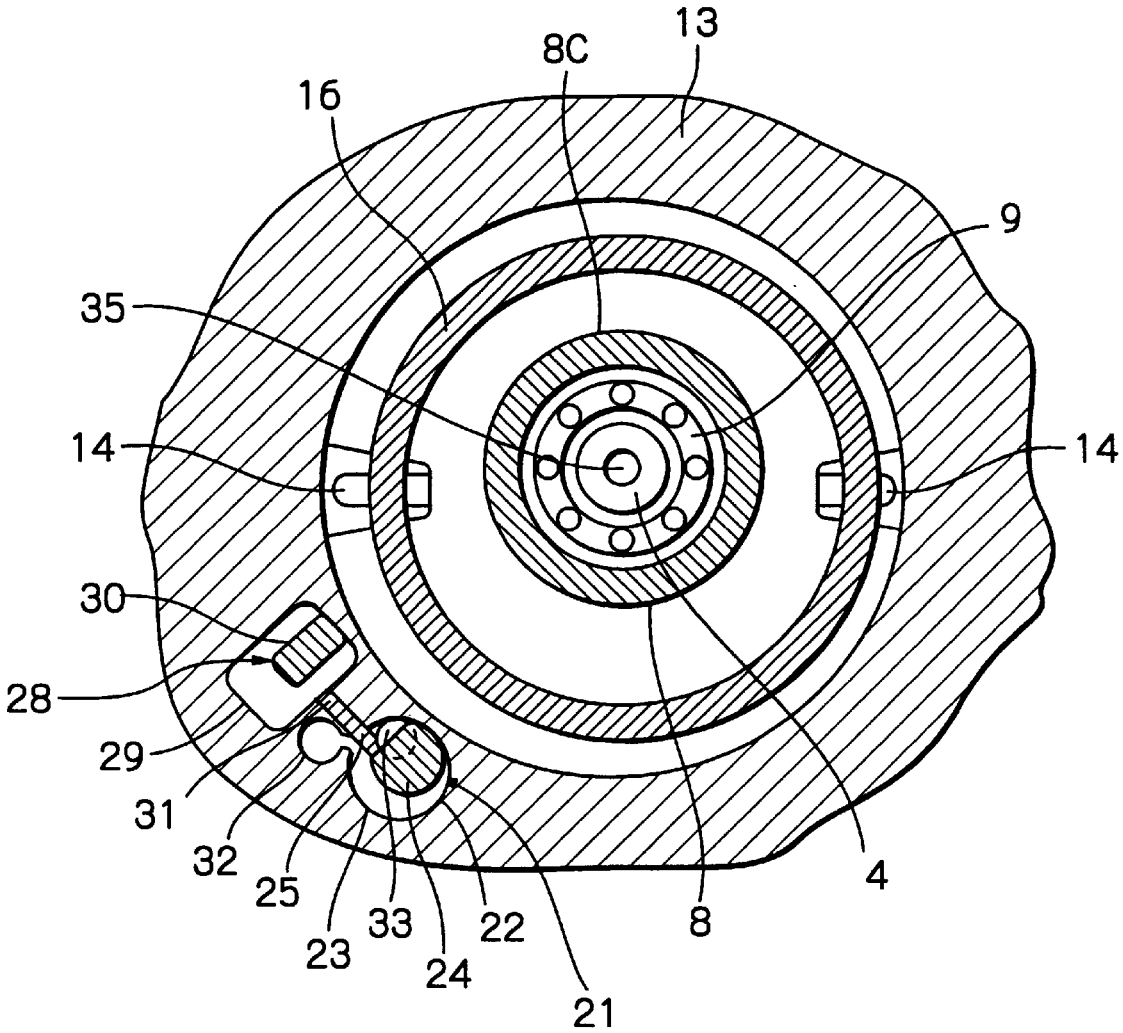
FIG. 5 is a sectional view as seen in the direction of the arrow V—V in FIG. 3, showing the thrust bearing, an Oldham's ring, the lubrication pump, etc.

Referring to FIG. 5, a pair of guide projections 14 project radially inward from the inner periphery of the thrust bearing 13. The guide projections 14 slidably guide an Oldham's ring 16 (described later) leftward or rightward as viewed in FIG. 5.

Figure 6:
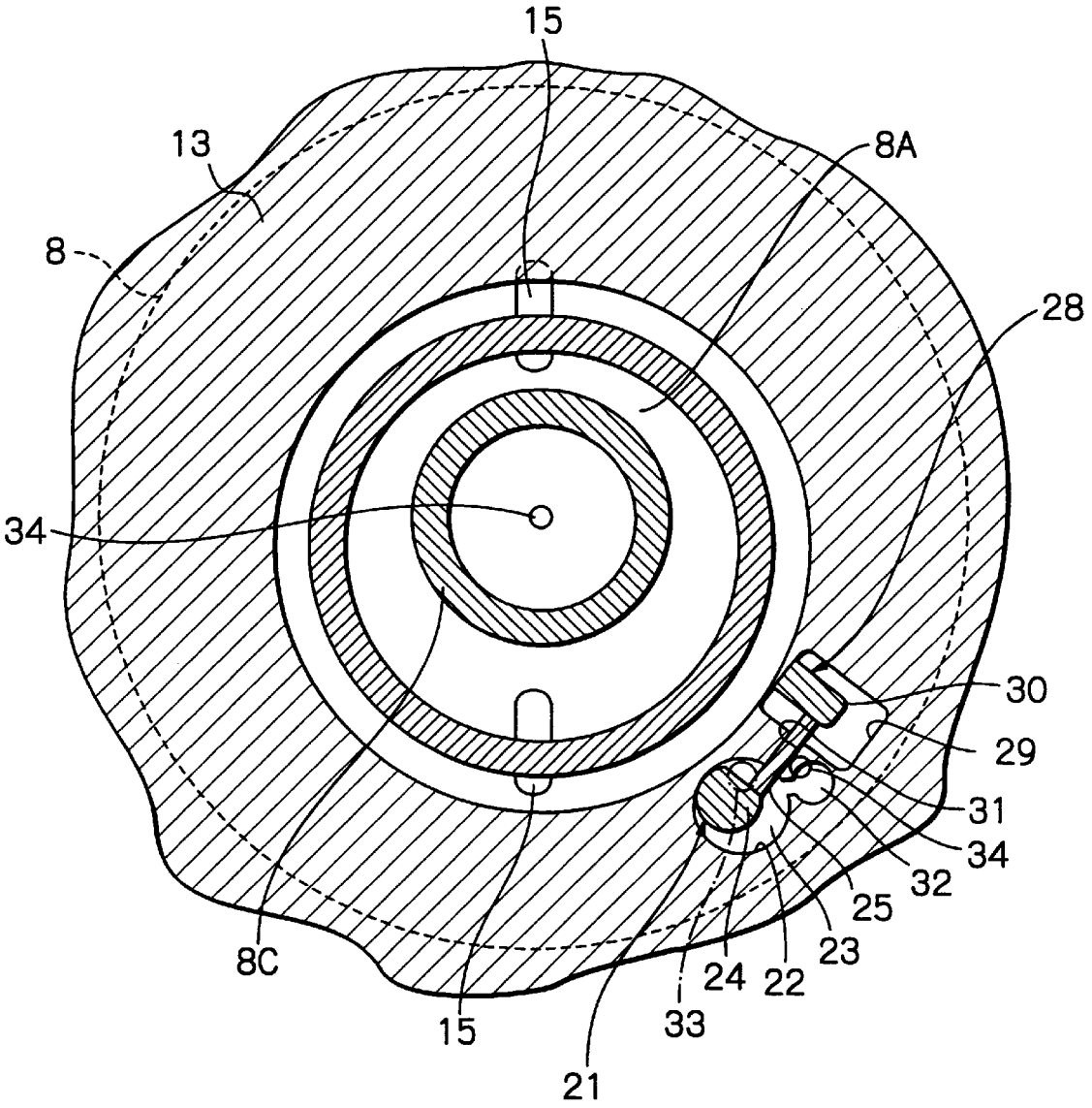
FIG. 6 is a sectional view as seen in the direction of the arrow VI—VI in FIG. 3, showing the orbiting scroll member, the Oldham's ring, the lubrication pump, etc.
Figure 7:
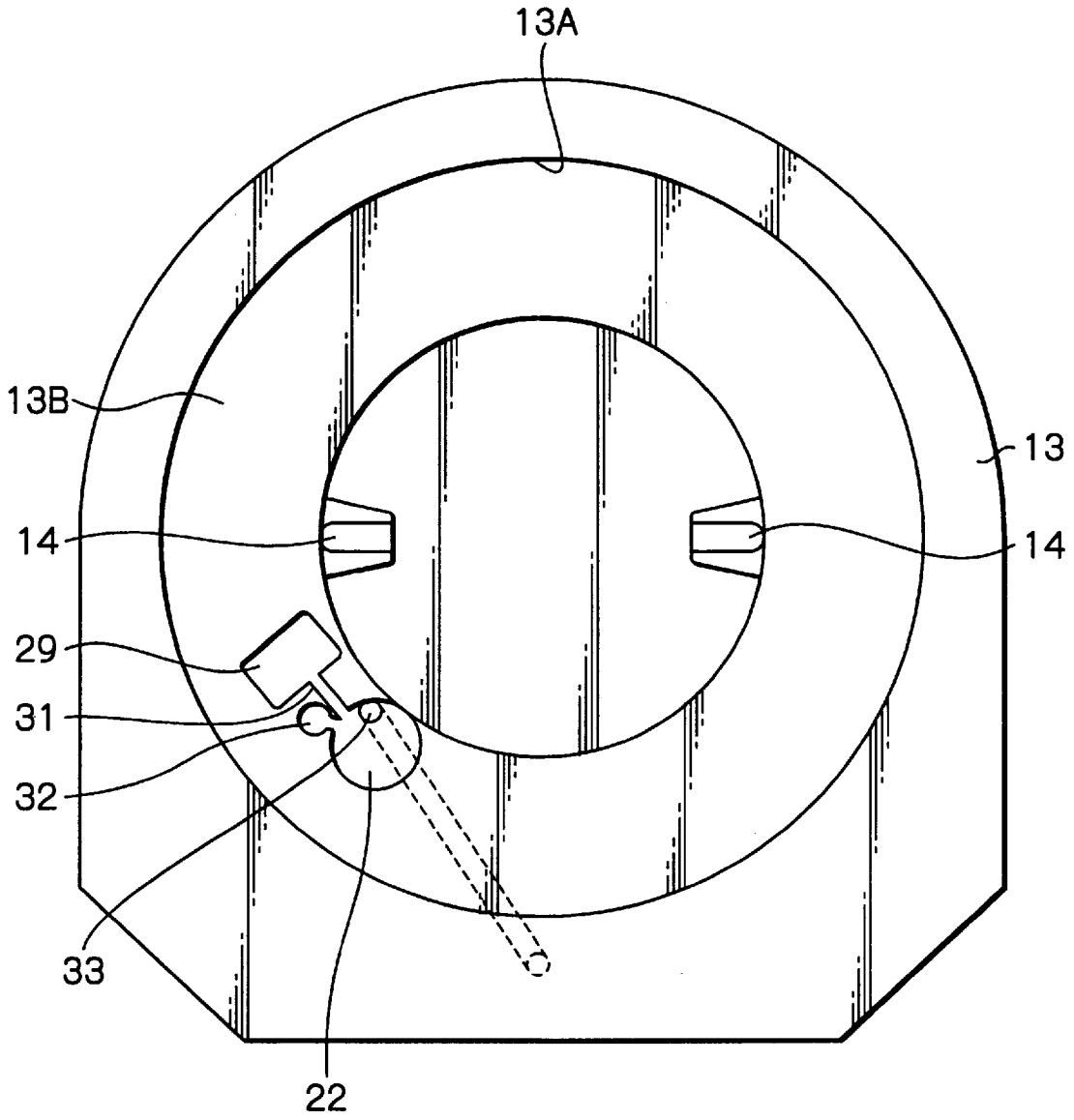
FIG. 7 is a front view as seen in the direction of the arrow VII—VII in FIG. 1, showing only the thrust bearing.
Figure 8:
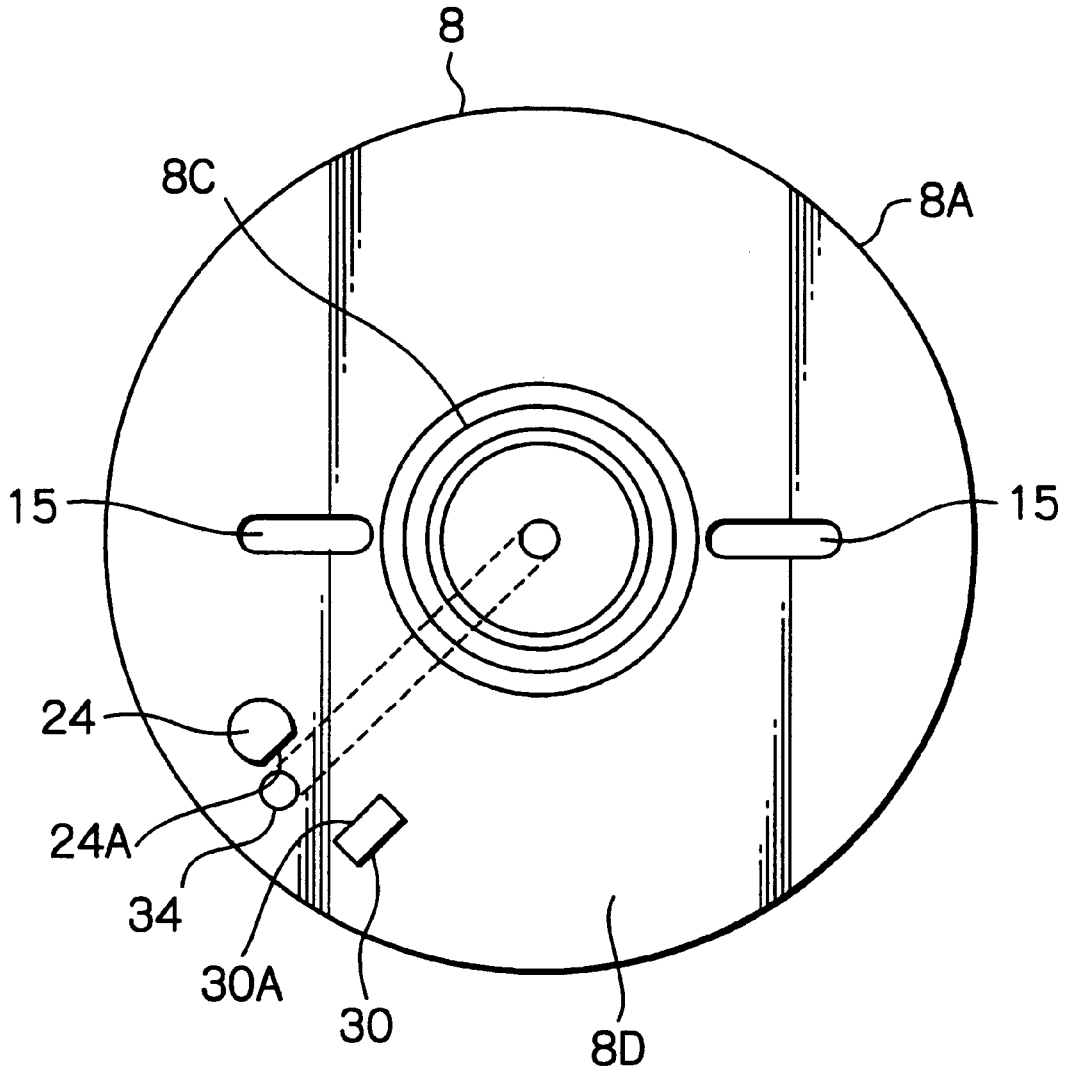
FIG. 8 is a rear view as seen in the direction of the arrow VIII—VIII in FIG. 1, showing only the orbiting scroll member.

Referring to FIG. 6, Oldham's ring guide grooves 15 are provided on the rear side of the end plate 8A of the orbiting scroll member 8. The guide grooves 15 slidably guide the Oldham's ring 16 upward or downward as viewed in FIG. 6.

The Oldham's ring 16 is slidably provided between the orbiting scroll member 8 and the thrust bearing 13. The Oldham's ring 16 is guided in two orthogonal axis directions by the guide projections 14 and the guide grooves 15. The Oldham's ring 16 constitutes a rotation preventing mechanism for preventing rotation of the orbiting scroll member 8 in combination with the guide projections 14 and the guide grooves 15.

A lubrication pump 21 is provided between the respective sliding contact surfaces 8D and 13B of the orbiting scroll member 8 and the thrust bearing 13. The lubrication pump 21 comprises an orbiting member accommodating recess 22, an orbiting member 24, a slide plate 25 and a slide plate driving mechanism 28 (described later). The lubrication pump 21 operates in response to the motion of the orbiting scroll member 8 to discharge the lubricant 2 sucked into a pump chamber 23 (described later) to various lubricating points, i.e. the driving shaft 4, the bearings 5 and 6, the orbiting scroll member 8, and the orbiting bearing 9.

Figure 9:
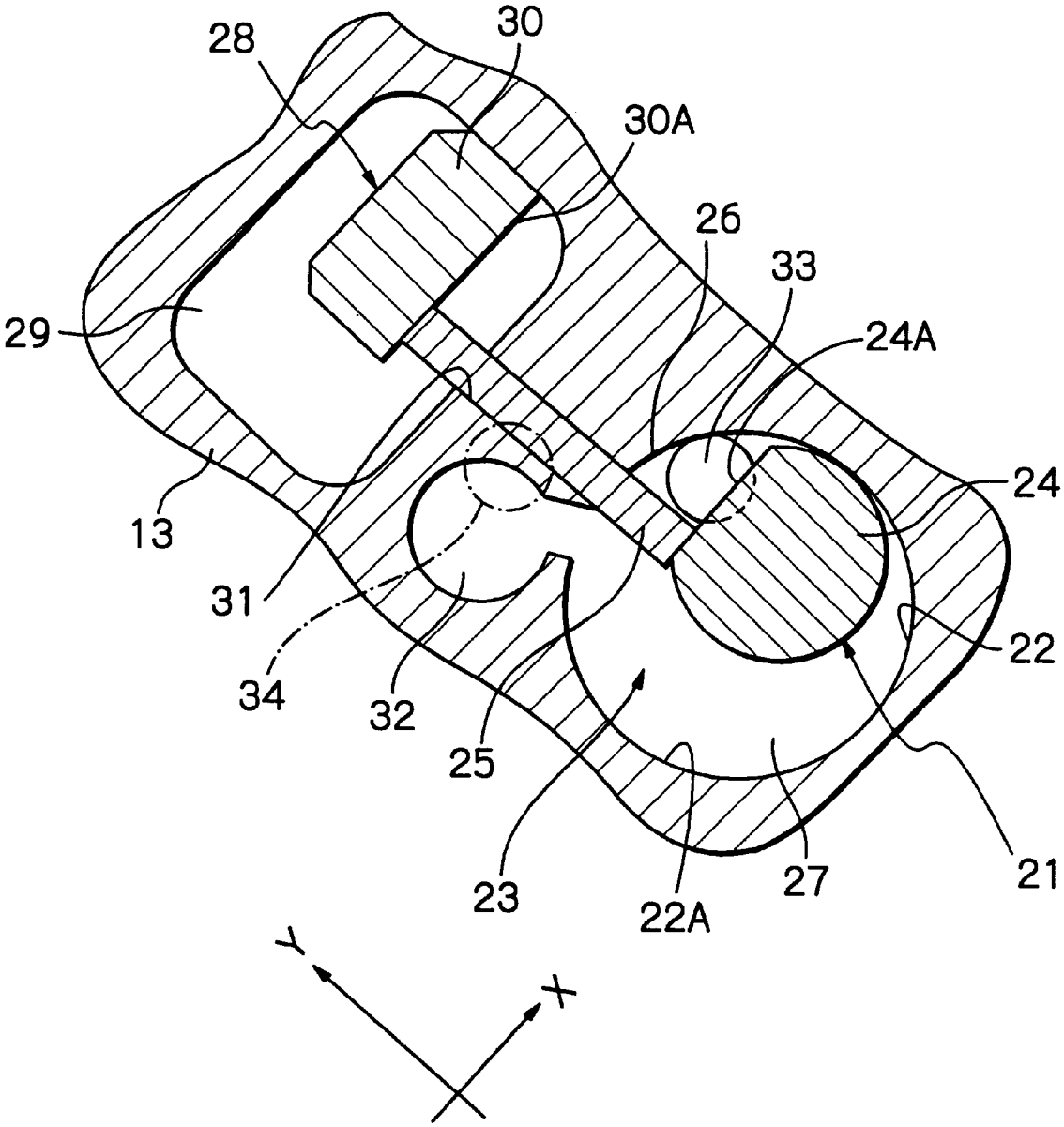
FIG. 9 is a fragmentary enlarged sectional view of the lubrication pump in FIG. 6.

The orbiting member accommodating recess 22 is provided in the sliding contact surface 13B of the thrust bearing 13. As shown in FIG. 9, the orbiting member accommodating recess 22 is a closed-end circular hole with a peripheral wall surface 22A to define a pump chamber 23 between itself and the sliding contact surface 8D of the orbiting scroll member 8. The orbiting member 24 is orbitably accommodated in the pump chamber 23 formed by the orbiting member accommodating recess 22.

The orbiting member 24 projects from the rear side of the end plate 8A of the orbiting scroll member 8. The orbiting member 24 is a circular projection projecting from the end plate 8A of the orbiting scroll member 8 into the orbiting member accommodating recess 22. The projecting end surface of the orbiting member 24 is substantially in sliding contact with the bottom surface of the orbiting member accommodating recess 22. The orbiting member 24 has a sliding contact surface 24A formed on the outer periphery thereof. The sliding contact surface 24A is a plane surface extending in a direction perpendicular to the lengthwise direction of a guide groove 31 (described later). That is, the sliding contact surface 24A extends in the X-axis direction in FIG. 9. The sliding contact surface 24A is in sliding contact with the slide plate 25.

The orbiting member 24 is placed in the orbiting member accommodating recess 22 in a decentered position. The outer peripheral surface of the orbiting member 24 is substantially in sliding contact with the peripheral wall surface 22A. Consequently, the orbiting member 24 moves in response to the motion of the orbiting scroll member 8, performing an orbiting motion in the orbiting member accommodating recess 22 along the peripheral wall surface 22A. It should be noted that the X- and Y-axis directions in FIG. 9 are at an angle of approximately 45 degrees to the guide projections 14 and the guide grooves 15.

The slide plate 25 is movably provided in the orbiting member accommodating recess 22 to serve as a movable partition. The slide plate 25 is a rectangular flat plate member and provided in a guide groove 31 (described later) so as to be slidable in the Y-axis direction in FIG. 9. Both ends of the slide plate 25 in the lengthwise direction thereof are in sliding contact with the sliding contact surface 24A of the orbiting member 24 and a sliding contact surface 30A of a driving projection 30 (described later), respectively.

Figure 10:
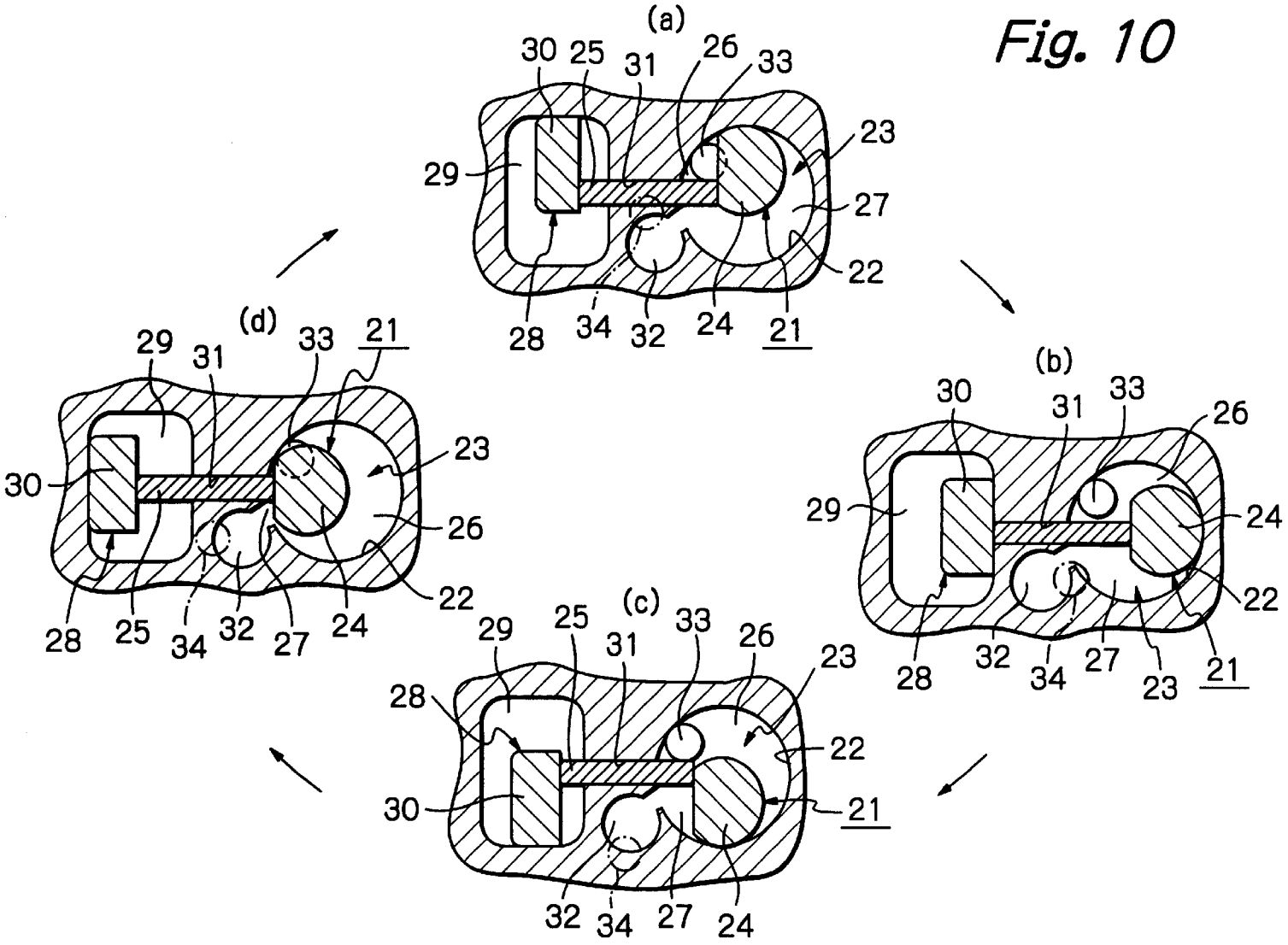
FIG. 10 is a diagram showing the operation of the lubrication pump in the embodiment of the present invention.

Consequently, as the orbiting scroll member 8 orbits, as shown in FIG. 10, the slide plate 25 is caused to move in the orbiting member accommodating recess 22 by a slide plate driving mechanism 28 (described later) in response to the motion of the orbiting member 24. The slide plate 25 divides the pump chamber 23 into a suction chamber 26 and a discharge chamber 27 in cooperation with the orbiting member 24.

The slide plate driving mechanism 28 is a partition moving mechanism for moving the slide plate 25 in the orbiting member accommodating recess 22 in response to the motion of the orbiting member 24. The slide plate driving mechanism 28 comprises a cavity 29, a driving projection 30 and a guide groove 31 (described later).

The cavity 29 is provided in the sliding contact surface 13B of the thrust bearing 13 at a distance from the orbiting member accommodating recess 22. The cavity 29 has an approximately rectangular shape. The driving projection 30 is accommodated in the cavity 29.

The driving projection 30 projects from the rear side of the end plate 8A of the orbiting scroll member 8. As shown in FIG. 9, the driving projection 30 is a rectangular projection projecting from the end plate 8A into the cavity 29. The driving projection 30 has a sliding contact surface 30A that is a plane surface facing the sliding contact surface 24A of the orbiting member 24 in the Y-axis direction and extending parallel to the X-axis direction. The sliding contact surface 30A is in sliding contact with the slide plate 25.

Consequently, as the orbiting scroll member 8 orbits, the driving projection 30 performs an orbiting motion together with the orbiting member 24, causing the slide plate 25 to slide in the Y-axis direction along the guide groove 31 in such a state that the slide plate 25 is held between the driving projection 30 and the orbiting member 24. The driving projection 30 further constitutes another rotation preventing mechanism for preventing rotation of the orbiting scroll member 8 in combination with the orbiting member 24 and the slide plate 25 for the reason stated later.

The slide plate guide groove 31 is provided in the sliding contact surface 13B of the thrust bearing 13 to extend between the orbiting member accommodating recess 22 and the cavity 29. The guide groove 31 is an elongate groove extending in the Y-axis direction in FIG. 9. The guide groove 31 is contiguous at both ends thereof with the orbiting member accommodating recess 22 and the cavity 29. The guide groove 31 slidably guides the slide plate 25 in the Y-axis direction.

A lubricant reservoir 32 is provided in the sliding contact surface 13B of the thrust bearing 13 at a position between the orbiting member accommodating recess 22 and the cavity 29. The lubricant reservoir 32 is a circular hole that opens in the sliding contact surface 13B of the thrust bearing 13 and is contiguous with the orbiting member accommodating recess 22. As shown in FIG. 10, the lubricant reservoir 32 is provided at a position where it communicates with both the orbiting member accommodating recess 22 and a discharge passage 34 at all times during the orbiting cycle of the orbiting scroll member 8. Accordingly, the lubricant reservoir 32 can deliver the lubricant 2 from the discharge chamber 27 to the discharge passage 34 at all times.

A suction passage 33 is formed in the thrust bearing 13. One end of the suction passage 33 opens into the casing 1 at a lower portion of the thrust bearing 13. The other end of the suction passage 33 opens on the bottom surface of the orbiting member accommodating recess 22 at a position within the suction chamber 26. The suction passage 33 leads the lubricant 2 contained in the casing 1 into the suction chamber 26 by the operation of the lubrication pump 21.

The discharge passage 34 is formed in the end plate 8A of the orbiting scroll member 8. The discharge passage 34 extends through the rear side of the orbiting scroll member 8 and opens at one end thereof into the lubricant reservoir 32. The other end of the discharge passage 34 opens into the boss portion 8C. The discharge passage 34 is arranged such that the lubricant 2 discharged from the discharge chamber 27 and stored in the lubricant reservoir 32 is delivered from the rear side of the end plate 8A of the orbiting scroll member 8 to the driving shaft 4, the orbiting bearing 9, etc., and that while flowing through the discharge passage 34, the lubricant 2 cools the whole orbiting scroll member 8.

A lubricant supply passage 35 is formed in the driving shaft 4. The lubricant supply passage 35 axially extends through the driving shaft 4. One end of the lubricant supply passage 35 opens into the boss portion 8C of the orbiting scroll member 8 to communicate with the discharge passage 34. The other end of the lubricant supply passage 35 bends radially and opens into the bearing portion 1C of the casing 1 to supply the lubricant 2 from the discharge passage 34 to the bearings 5 and 6. Moreover, while flowing through the lubricant supply passage 35, the lubricant 2 cools the whole driving shaft 4.

In addition, the lubricant supply passage 35 has a portion extending radially from an intermediate part thereof and opening into the casing 1 between the bearing portion 1C of the casing 1 and the boss portion 8C of the orbiting scroll member 8 to return a part of the lubricant 2 from the discharge passage 34 into the casing 1.

A seal member 36 is fitted between the respective sliding contact surfaces of the fixed and orbiting scroll members 3 and 8. The seal member 36 prevents the lubricant 2 from entering the area between the two sliding contact surfaces.

The scroll air compressor according to the embodiment has the above-described arrangement. Next, the operation of the scroll air compressor will be described.

As the driving shaft 4 is rotated by an electric motor, the orbiting scroll member 8 performs a circular (orbiting) motion with an orbiting radius $\delta$ about the driving shaft 4.

Consequently, the compression chambers 10, which are defined between the wrap portion 3B of the fixed scroll member 3 and the wrap portion 8B of the orbiting scroll member 8, are continuously contracted. Thus, the outside air sucked in from the suction opening 11 of the fixed scroll member 3 is successively compressed in the compression chambers 10, and the compressed air is discharged from the discharge opening 12 of the fixed scroll member 3 and stored in an external air tank or the like (not shown).

When the orbiting scroll member 8 is orbiting in this way, the Oldham's ring 16 slides along the guide projections 14 of the thrust bearing 13, and the Oldham's ring 16 and the orbiting scroll member 8 are displaced relative to each other along the guide grooves 15 provided on the orbiting scroll member 8. Thus, rotational torque acting on the orbiting scroll member 8, which is transmitted through the driving shaft 4, is borne between the Oldham's ring 16 and the guide projections 14 and the guide grooves 15, thereby preventing the orbiting scroll member 8 from rotating on its own axis while allowing it to perform an orbiting motion with an orbiting radius δ.

Next, the operation of the lubrication pump 21 will be described with reference to FIG. 10. As the orbiting scroll member 8 orbits, the orbiting member 24 and the driving projection 30, which are integral with the orbiting scroll member 8, perform orbiting motions clockwise in the orbiting member accommodating recess 22 and the cavity 29, respectively, as shown sequentially in parts (a), (b), (c) and (d) of FIG. 10. At this time, the slide plate 25 follows the motions of the orbiting member 24 and the driving projection 30 in a state where both ends of the slide plate 25 are in sliding contact with the orbiting member 24 and the driving projection 30. Thus, the slide plate 25 slides along the guide groove 31.

Consequently, in the pump chamber 23, which is defined between the orbiting member accommodating recess 22 and the orbiting scroll member 8, the volume of the suction chamber 26 continuously increases in response to the motion of the slide plate 25 as shown sequentially in parts (a), (b), (c) and (d) of FIG. 10. Thus, a suction stroke is performed during which the lubricant 2 in the casing 1 is sucked into the suction chamber 26 through the suction passage 33.

On the other hand, the volume of the discharge chamber 27 continuously decreases in response to the motion of the slide plate 25 as shown sequentially in parts (a), (b), (c) and (d) of FIG. 10. Thus, a discharge stroke is performed during which the lubricant 2 in the discharge chamber 27 is discharged from the lubricant reservoir 32 to the discharge passage 34.

When the orbiting member 24 reaches the position shown in part (d) of FIG. 10, the volume of the suction chamber 26 reaches a maximum, and thus the suction stroke is completed. On the other hand, the volume of the discharge chamber 27 reaches a minimum, and thus the lubricant discharge stroke is completed. During the period that the orbiting member 24 returns to the position in part (a) from the position in part (d) of FIG. 10, the opening of the suction passage 33 is closed by the orbiting member 24. Then, the subsequent cycle starts.

Thus, in this embodiment, even if there are variations in the level of the lubricant 2, because the inlet of the suction passage 33 is located sufficiently low, the lubricant 2 in the casing 1 can be stably delivered from the discharge passage 34 to the driving shaft 4 by the lubrication pump 21 to lubricate and cool the orbiting bearing 9. In addition, the lubricant 2 from the discharge passage 34 can be stably supplied to the bearings 5 and 6 in the bearing portion 1C through the lubricant supply passage 35 to lubricate and cool the bearings 5 and 6. While flowing through the discharge passage 34 and the lubricant supply passage 35, the lubricant 2 also cools the orbiting scroll member 8 and the driving shaft 4. Thus, the whole apparatus can be efficiently cooled.

Further, because the lubricant reservoir 32 and the discharge passage 34 are constantly kept in communication with each other, it is possible to suppress variations in pressure of the lubricant 2 in the lubricant reservoir 32 and the discharge chamber 27 and hence possible to suppress displacement of the orbiting scroll member 8 in the thrust direction which may be caused by the variations in pressure.

In this embodiment, the lubrication pump 21 has the pump chamber 23, which includes the suction chamber 26 and the discharge chamber 27, and the pump chamber 23 is provided between the sliding contact surfaces 8D and 13B of the orbiting scroll member 8 and the thrust bearing 13. That is, the pump chamber 23 is provided on the side of the end plate 8A of the orbiting scroll member 8 remote from the compression chambers 10. Thus, the pump chamber 23 can be isolated from the compression chambers 10.

Accordingly, there is no likelihood that the high pressure of the lubricant 2 pressurized in the pump chamber 23 will act on the outer periphery-side sliding contact surfaces of the fixed and orbiting scroll members 3 and 8 as stated in regard to the prior art. Therefore, it is possible to prevent occurrence of the problem that the lubricant 2 entering the area between the sliding contact surfaces 8D and 13B leaks into the compression chambers 10 through the seal member 36. Thus, it is possible to discharge clean compressed air from the discharge opening 12 to the outside at all times, and hence the apparatus can be improved in performance, reliability and so forth.

In addition, the sliding contact surface 13B of the thrust bearing 13 is provided with the lubricant reservoir 32 constantly communicating with the orbiting member accommodating recess 22 and the discharge passage 34. Therefore, while the opening of the discharge passage 34 is orbiting in response to the motion of the orbiting scroll member 8 as shown by the chain line in FIG. 10, the lubricant 2 from the discharge chamber 27 can be smoothly delivered to the discharge passage 34 at all times. Accordingly, the efficiency of delivery of the lubricant 2 by the lubrication pump 21 can be increased, and thus the pump performance can be improved.

The orbiting member 24 and the driving projection 30, which are each integrally provided on the orbiting scroll member 8, are positioned so that their respective sliding contact surfaces 24A and 30A, which are in sliding contact with the slide plate 25, extend perpendicularly to the Y-axis direction and parallel to each other. Therefore, the orbiting member 24 and the driving projection 30 can slide in the X-axis direction relative to the slide plate 25.

In this case, the slide plate 25 slides in the Y-axis direction along the guide groove 31 provided on the thrust bearing 13, as stated above, and therefore, the direction of the sliding contact surfaces of the orbiting member 24 and the slide plate 25 is maintained in a direction perpendicular to the Y-axis. Thus, the orbiting member 24, the slide plate 25, the driving projection 30 and the guide groove 31 constitute another rotation preventing mechanism for preventing rotation of the orbiting scroll member 8. Accordingly, rotational torque from the orbiting scroll member 8 that is added to the rotation preventing mechanism comprising the Oldham's ring 16, etc. can be reduced by the above-described rotation preventing mechanism, and thus the durability, lifetime, etc. of the Oldham's ring 16 can be increased.

Furthermore, because the slide plate 25 is held between the orbiting member 24 and the driving projection 30, the slide plate 25 can slide along the guide groove 31 in response to the motion of the orbiting member 24 and driving projection 30. Accordingly, it is possible to eliminate such a problem that the slide plate 25 moves in the orbiting member accommodating recess 22 in retard of the motion of the orbiting member 24. Thus, the follow-up performance of the slide plate 25 with respect to the orbiting member 24 is improved. Consequently, the pump performance of the lubrication pump 21 can be further improved.

Although in the foregoing embodiment the orbiting member 24 is provided on the sliding contact surface 8D of the orbiting scroll member 8 and the orbiting member accommodating recess 22 is provided on the sliding contact surface 13B of the thrust bearing 13, the arrangement may be such that the orbiting member accommodating recess is provided on the sliding contact surface 8D of the orbiting scroll member 8 and the orbiting member is provided on the sliding contact surface 13B of the thrust bearing 13.

Although in the foregoing embodiment the present invention has been described with regard to a scroll air compressor as an example of scroll fluid machines, the present invention is not necessarily limited to the scroll air compressor, but may also be widely applied to other scroll fluid machines, e.g. vacuum pumps, refrigerant compressors, etc.

What is claimed is:

1. A scroll fluid machine comprising:

a casing;

a fixed scroll member provided in said casing, said fixed scroll member having a spiral wrap portion standing on an end plate;

a driving shaft rotatable provided in said casing;

an orbiting scroll member orbitably provided at a distal end of said driving shaft through an orbiting bearing in said casing, said orbiting scroll member having a spiral wrap portion standing on an end plate so as to overlap the wrap portion of said fixed scroll member to define a plurality of compression chambers;

a thrust bearing provided in said casing so as to come in sliding contact with a rear side of said orbiting scroll member to bear a thrust load acting on said orbiting scroll member;

a lubrication pump provided between the rear side of said orbiting scroll member and said thrust bearing, said lubrication pump having a pump chamber formed between a sliding contact surface on the rear side of said orbiting scroll member and a sliding contact surface of said thrust bearing, said lubrication pump operating in response to a motion of said orbiting scroll member;

a lubricant suction passage provided in said thrust bearing to lead a lubricant contained in said casing into the pump chamber of said lubrication pump; and a discharge passage provided in said orbiting scroll member to deliver the lubricant sucked into the pump chamber of said lubrication pump to lubricating points.

2. A scroll fluid machine according to claim 1, wherein said lubrication pump has:

an orbiting member accommodating recess provided in either one of the sliding contact surface on the rear side of said orbiting scroll member and the sliding contact surface of said thrust bearing to define said pump chamber by said orbiting member accommodating recess and the other of said sliding contact surfaces;

an orbiting member projecting from said the other of said sliding contact surfaces into said orbiting member accommodating recess, said orbiting member performing a relative orbiting motion along a peripheral wall surface of said orbiting member accommodating recess in response to the motion of said orbiting scroll member;

a movable partition provided in said orbiting member accommodating recess so as to be movable relative to said orbiting member accommodating recess, said movable partition cooperating with said orbiting member to divide said pump chamber into a suction chamber and a discharge chamber in said orbiting member accommodating recess; and a partition driving mechanism for driving said movable partition to perform relative movement in said orbiting member accommodating recess in response to a motion of said orbiting member.

3. A scroll fluid machine according to claim 2, wherein said one of said sliding contact surfaces is provided with a lubricant reservoir constantly communicating with said orbiting member accommodating recess and said discharge passage.

4. A scroll fluid machine according to claim 3, wherein said discharge passage extends through the rear side portion of said orbiting scroll member and opens in a boss portion accommodating said orbiting bearing.

5. A scroll fluid machine according to claim 4, wherein said driving shaft is provided with a balance weight projecting radially from an outer periphery of said driving shaft to obtain a rotational balance of said driving shaft with respect to said orbiting scroll member, said driving shaft being further provided with a lubricant supply passage opening at one end thereof at the distal end of said driving shaft to communicate with said discharge passage, the other end of said lubricant supply passage opening at an outer peripheral surface of said driving shaft on a rear side of said boss portion.

6. A scroll fluid machine according to claim 2, wherein said discharge passage extends through the rear side portion of said orbiting scroll member and opens in a boss portion accommodating said orbiting bearing.

7. A scroll fluid machine according to claim 6, wherein said driving shaft is provided with a balance weight projecting radially from an outer periphery of said driving shaft to obtain a rotational balance of said driving shaft with respect to said orbiting scroll member, said driving shaft being further provided with a lubricant supply passage opening at one end thereof at the distal end of said driving shaft to communicate with said discharge passage, the other end of said lubricant supply passage opening at an outer peripheral surface of said driving shaft on a rear side of said boss portion.

8. A scroll fluid machine according to claim 2, wherein said partition driving mechanism has:

a cavity provided in said one of said sliding contact surfaces at a distance from said orbiting member accommodating recess;

a guide groove formed in said one of said sliding contact surfaces between said cavity and said orbiting member accommodating recess, said guide groove being contiguous at both longitudinal ends thereof with said cavity and said orbiting member accommodating recess; and a driving projection projecting from said the other of said sliding contact surfaces into said cavity, said driving projection performing a relative orbiting motion in said cavity in response to the motion of said orbiting scroll member;

wherein said movable partition is a slide plate slidably held between said orbiting member and said driving projection, said slide plate being slidable longitudinally along said guide groove.

9. A scroll fluid machine according to claim 8, wherein sliding contact surfaces of said orbiting member and said driving projection that are in sliding contact with said slide plate are plane surfaces which are parallel to each other.

10. A scroll fluid machine according to claim 9, wherein said discharge passage extends through the rear side portion of said orbiting scroll member and opens in a boss portion accommodating said orbiting bearing.

11. A scroll fluid machine according to claim 10, wherein said driving shaft is provided with a balance weight projecting radially from an outer periphery of said driving shaft to obtain a rotational balance of said driving shaft with respect to said orbiting scroll member, said driving shaft being further provided with a lubricant supply passage opening at one end thereof at the distal end of said driving shaft to communicate with said discharge passage, the other end of said lubricant supply passage opening at an outer peripheral surface of said driving shaft on a rear side of said boss portion.

12. A scroll fluid machine according to claim 8, wherein said discharge passage extends through the rear side portion of said orbiting scroll member and opens in a boss portion accommodating said orbiting bearing.

13. A scroll fluid machine according to claim 12, wherein said driving shaft is provided with a balance weight projecting radially from an outer periphery of said driving shaft to obtain a rotational balance of said driving shaft with respect to said orbiting scroll member, said driving shaft being further provided with a lubricant supply passage opening at one end thereof at the distal end of said driving shaft to communicate with said discharge passage, the other end of said lubricant supply passage opening at an outer peripheral surface of said driving shaft on a rear side of said boss portion.

14. A scroll fluid machine according to claim 8, wherein said one of said sliding contact surfaces is provided with a lubricant reservoir constantly communicating with said orbiting member accommodating recess and said discharge passage.

15. A scroll fluid machine according to claim 14, wherein said discharge passage extends through the rear side portion of said orbiting scroll member and opens in a boss portion accommodating said orbiting bearing.

16. A scroll fluid machine according to claim 15, wherein said driving shaft is provided with a balance weight projecting radially from an outer periphery of said driving shaft to obtain a rotational balance of said driving shaft with respect to said orbiting scroll member, said driving shaft being further provided with a lubricant supply passage opening at one end thereof at the distal end of said driving shaft to communicate with said discharge passage, the other end of said lubricant supply passage opening at an outer peripheral surface of said driving shaft on a rear side of said boss portion.

17. A scroll fluid machine according to claim 1, wherein said discharge passage extends through the rear side portion of said orbiting scroll member and opens in a boss portion accommodating said orbiting bearing.

18. A scroll fluid machine according to claim 6, wherein said driving shaft is provided with a balance weight projecting radially from an outer periphery of said driving shaft to obtain a rotational balance of said driving shaft with respect to said orbiting scroll member, said driving shaft being further provided with a lubricant supply passage opening at one end thereof at the distal end of said driving shaft to communicate with said discharge passage, the other end of said lubricant supply passage opening at an outer peripheral surface of said driving shaft on a rear side of said boss portion.

* * * * *